US005692320A

United States Patent [19]

Nichols

[11] Patent Number: 5,692,320

[45] Date of Patent: Dec. 2, 1997

[54] SHOCK ABSORBING LACING SYSTEM FOR A SHOE

[75] Inventor: Steven B. Nichols, Los Angeles, Calif.

[73] Assignee: K-Swiss Inc., Chatsworth, Calif.

[21] Appl. No.: 457,101

[22] Filed: Jun. 1, 1995

Related U.S. Application Data

[63] Continuation-in-part of Ser. No. 174,616, Dec. 27, 1993, abandoned, which is a continuation of Ser. No. 10,353, Jan. 28, 1993, abandoned.

[51] Int. Cl.[6] ..... A43B 11/00

[52] U.S. Cl. ..... 36/51; 36/170

[58] Field of Search ..... 36/50.1, 51, 89, 36/93, 145, 173, 170, 114, 9 R

[56] References Cited

U.S. PATENT DOCUMENTS

| | | | |
|---|---|---|---|
| 422,840 | 3/1890 | Schroeder | 36/51 |
| 913,012 | 2/1909 | Jackson | 36/51 |
| 1,441,849 | 1/1923 | Grayson | 36/51 X |
| 1,497,568 | 6/1924 | Kelley | 36/51 |
| 1,712,481 | 5/1929 | Ayers | 36/170 |
| 2,147,197 | 2/1939 | Glidden | 36/3 A X |
| 4,870,761 | 10/1989 | Tracy | 36/51 |
| 5,271,130 | 12/1993 | Batra | 36/50.1 X |
| 5,377,430 | 1/1995 | Hatfield et al. | 36/50.1 X |
| 5,497,564 | 3/1996 | Allen et al. | 36/50.1 |

FOREIGN PATENT DOCUMENTS

| | | | |
|---|---|---|---|
| 8805 | of 1910 | United Kingdom | 36/51 |

*Primary Examiner*—B. Dayoan

[57] ABSTRACT

A lace up shoe with shock absorbing and tensioning members which provides for a superior fit of the shoe to the wearer's foot and which provides for pronation and supination countering adjustability. The shock absorbing and tensioning member is affixed to the shoe at its lower region to the upper and/or the sole in the quarter area of the shoe at the medial and/or lateral sides of the shoe and has shoe lace engaging rings at its upper region. The user can selectively lace the shoe laces through some or all of these rings, on one or both the medial and/or lateral sides of the shoe, to put additional shock absorbency on one or both the medial and lateral sides of the shoe, to counteract pronation and supination.

18 Claims, 3 Drawing Sheets

SHOCK ABSORBING LACING SYSTEM FOR A SHOE

CROSS-REFERENCE TO RELATED APPLICATIONS

This application is a continuation-in-part of U.S. patent application Ser. No. 08/174,616, filed Dec. 27, 1993, which is a continuation of U.S. patent application Ser. No. 08/010,353, filed Jan. 28, 1993, now abandoned.

BACKGROUND OF THE INVENTION

1. Field of the Invention

The invention relates to a shoe lacing system, and particularly to a shoe lacing system which has shock absorbing capacity.

2. Description of the Prior Art

The goal of lacing or buckling systems in shoes is to allow the wearer to easily put on and take off the shoe, while also providing for precise adjustment and fit of the shoe to the wearer's feet.

During the course of wearing a shoe, the ideal lacing tension can vary considerably depending on the activity in which the wearer is engaged. The fit of the shoe can also vary significantly at different times of the day. The shoe fit likewise can change during the various stages of ambulation. For example, when the wearer's foot comes down hard and compresses the mid-sole material, there will be a tendency for the fit of the upper to become slightly looser, and thereby allow the wearer's foot to shift about in the shoe. This shifting of the foot in the shoe can aggravate negative conditions, such as pronation or supination of the wearer's foot in a shoe.

While the prior art designs provide for additional support, or breathability, or give their shoes other qualities, the prior art design do not disclose any There is accordingly a need for a shoe lacing system which will provide for a more uniform fit of the shoe to the wearer's foot during all stages of the ambulation, and which can be used to compensate for negative conditions such as pronation or supination of the wearer's foot in a shoe.

The prior art discloses several shoe designs wherein flexible material is incorporated into the shoe design, attached to laces or straps to provide "give" to the laces. British Patent No. 8297, A.D. 1903 to Liebmann discloses a counter-entry shoe design incorporating a system in which a single lace with one working end is permanently affixed at a fixed end to an elastic band near the toe area of the shoe and is engageable at its working end to a second elastic band near the counter area of the shoe. The lace zig-zags between three hooks. The Liebmann design would not be expected to provide any significant shock absorbing capacity, particularly in the quarter area of the shoe, nor would it allow the wearer to put on the shoes without disengaging the working end of the lace and peeling the counter area of the shoe down.

U.S. Pat. No. 2,311,996 to Parker discloses a shoe having elastic gores incorporated directly into the quarter of the shoe. Conventional inelastic eyelet pieces, through which the laces are threaded, are affixed to the elastic gores. While some degree of flexibility is provided by this design, since the eyelet piece is relatively inflexible, the laces at each individual eyelet will have slight, if any, ability to adjust the shoe to the wearer's foot.

U.S. Pat. No. 4,870,761 to Tracy discloses a shoe construction having side panels made of a stretchable elastomeric material. Instead of utilizing a conventional lace, however, a single elasticized drawstring type cord passes through loops formed at the upper edges of the side panels. Moreover, shoes of the Tracy construction do not provide an adequate means to cinch up both the medial and lateral sides of the shoe in the lacing area of the shoe.

British Patent No. 339,319 to Bird discloses a leather strap shoe wherein the free end of the strap can be engaged with a button attached to a section of elastically mounted material, which mostly underlies the upper and which is affixed to the leather sole of the shoe at one side of the shoe.

The prior art also discloses patents on overlaying strap structures used in shoes to provide further support and stiffening to the shoe. For example, U.S. Pat. No. 2,147,197 to Glidden discloses a shoe with a highly elastic and breathable sock-like upper has a reinforcing structure overlaying it made of rubber, leather, fabric, or other materials. These reinforcing structures are less elastic than the underlying sock-like upper, and reinforce the otherwise overly flexible upper. In the embodiments of the shoe having shoe laces, the laces must be laced through eyelets on both sides of these structures, as the sock-like upper have no eyelets of their own. The Glidden shoes thus do not allow the wearer to adjust the degree of added reinforcement which is put on the shoe, i.e. on one side of the shoe, or on particular areas of the shoe.

U.S. Pat. No. 4,769,927 to Liggett et al. discloses a shoe with a non-stretchable stabilizing tapered strap which lies in the metatarsal region of the foot when the shoe is worn. This strap is sewn along with an overlying lateral strap to the upper of the shoe. The purpose of the strap is to stabilize the wearer's foot.

Notwithstanding the prior art, there remains a need for a shoe which has a structure to permit the user to selectively place additional shock absorbency to one or both sides of the shoe.

SUMMARY OF THE INVENTION

The invention set forth herein solves the problems outlined above by providing a unique structural arrangement, which can be used with conventional, nonelastic shoe laces.

The invention provides a shock absorbing shoe lacing system for shoes having a mid-sole and an outsole, an upper affixed to said mid-sole, said upper having a vamp area, a quarter area with a lacing area with lace attachment means positioned along the longitudinal line of the shoe, and a counter area, and a shoe lace, said shock absorbing shoe lacing system, comprising:

at least one elastic shock absorbing and tensioning member which has a top and a bottom region, said shock absorbing and tensioning member having a greater elasticity than said upper, said shock absorbing and tensioning member being attached at its bottom region to at least one of the outsole, the mid-sole, and the upper of the shoe in the quarter area of the shoe at one or both of the medial and lateral sides of the shoe, said shock absorbing and tensioning member overlying said upper of the shoe and having at least one lace engagement means positioned at its top region for engaging with said shoe lace;

whereby at least one of said shock absorbing and tensioning members can be manually placed under elastic tension, as desired, by lacing said conventional shoe lace through said lace engagement means of the elastic shock absorbing and tensioning means and/or the lace attachment means in the quarter area of the shoe, thereby providing enhanced shock absorbance and fitting of the shoe to the wearer's foot.

The invention yet further provides a shock absorbing shoe lacing system for shoes having a sole, an upper with a vamp area, a quarter area with lace attachment means positioned thereon, and a counter area, and a substantially inelastic shoe lace, comprising:

at least one elastic shock absorbing and tensioning member having a plurality of fingers at an upper region, which overlies the upper of the shoe and which is comparably more elastic than said upper, each finger carrying a shoe lace engaging member, a lower region which is affixed to at least one of the quarter, mid-sole and outsole, at least one of the medial and lateral sides of the shoe, the upper region of the shock absorbing and tensioning member being free floating on the outside of the upper, whereby when said conventional shoe lace is laced in a serpentine manner through the shoe lace engaging members of the shock absorbing and tensioning member and the lace attachment means, thereby placing the shock absorbing and tensioning member under elastic tension, the fit of the shoe to the wearer's foot can be adjusted.

The invention yet further provides footwear comprising a sole means, an upper affixed to said sole means comprising a vamp section, a quarter section and a counter section, and lacing means for lacing the upper quarter section, the improvement which comprises:

an elastic strap means which may be placed under tension manually overlying the upper and positioned in the quarter area of the shoe, said elastic strap means being more elastic than said upper;

a lower edge of said elastic strap means being affixed to at least one of the quarter areas of the upper and the mid-foot area of the sole means, upper portions of the elastic strap means being connectable to lacing means having transversely extending components, whereby tension on the elastic strap means can be normally adjusted by said lacing means, and whereby upon toe-off tension in said elastic strap means is decreased, and upon foot-strike tension on said elastic strap means is decreased, thereby providing shock absorption.

In another embodiment, the invention provides footwear comprising a sole, a non-elastic upper affixed to said sole, said upper comprising a vamp section, a quarter section and a counter section, and a non-elastic shoe lace for lacing the upper quarter section along a longitudinal axial direction, the improvement which comprises:

an elastic strap portion which may manually be placed under tension and which overlies the upper and is positioned in the quarter area of the shoe, said elastic strap portion being more elastic than said upper, a lower edge of said elastic strap portion being affixed to at least one of the quarter areas of said upper and mid-foot area of the sole, upper portions of the elastic strap portion being connectable to generally transversely extending components of said shoe lace, wherein said elastic strap portion comprises a wide lower portion and a narrower upper portion terminating in a plurality of connector strips approximately the same width as said shoe lace, said connector strips having connector means which permit said shoe lace to be engaged with said strips, whereby tension on the elastic strap portion can be normally adjusted by the tension placed on said shoe lace, and whereby, upon toe-off tension in said elastic strap portion is decreased, and upon foot-strike tension on said elastic strap portion is decreased, thereby providing shock absorption.

BRIEF DESCRIPTION OF THE DRAWINGS

The invention is described in greater detail with reference to the drawings.

DETAILED DESCRIPTION OF THE PREFERRED EMBODIMENT

Figure 1:
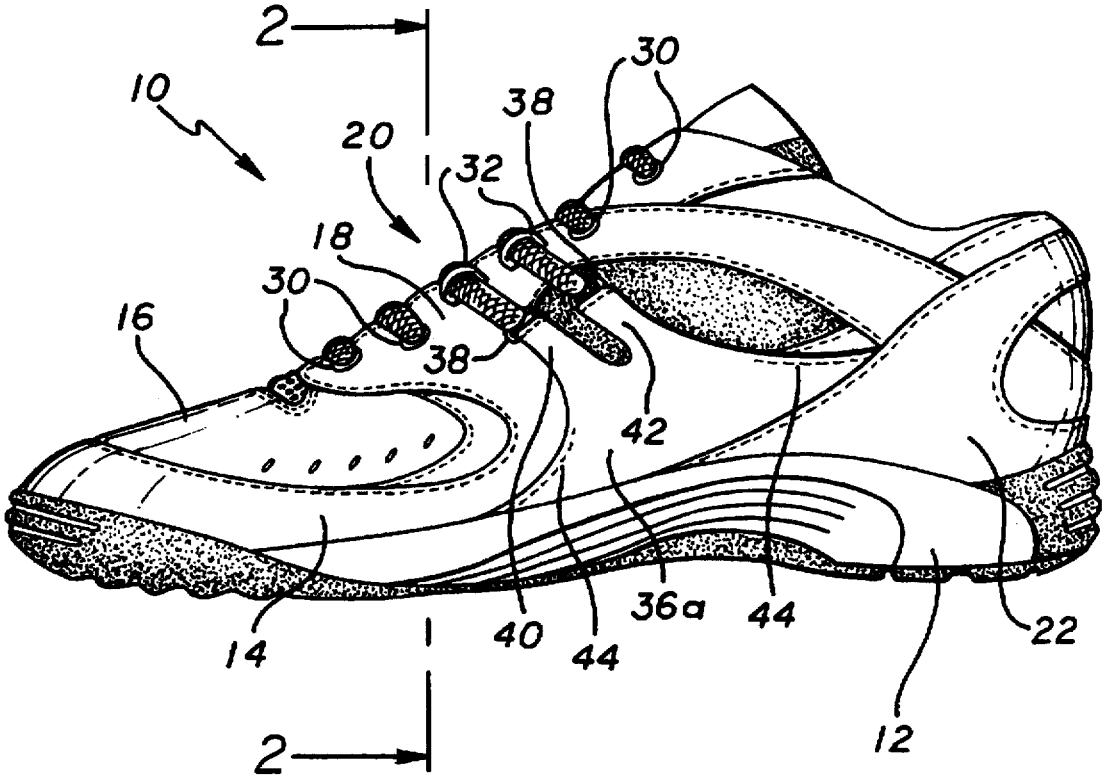
FIG. 1 is a side view of a first embodiment of the shock absorbing lace system of the invention.
Figure 2:
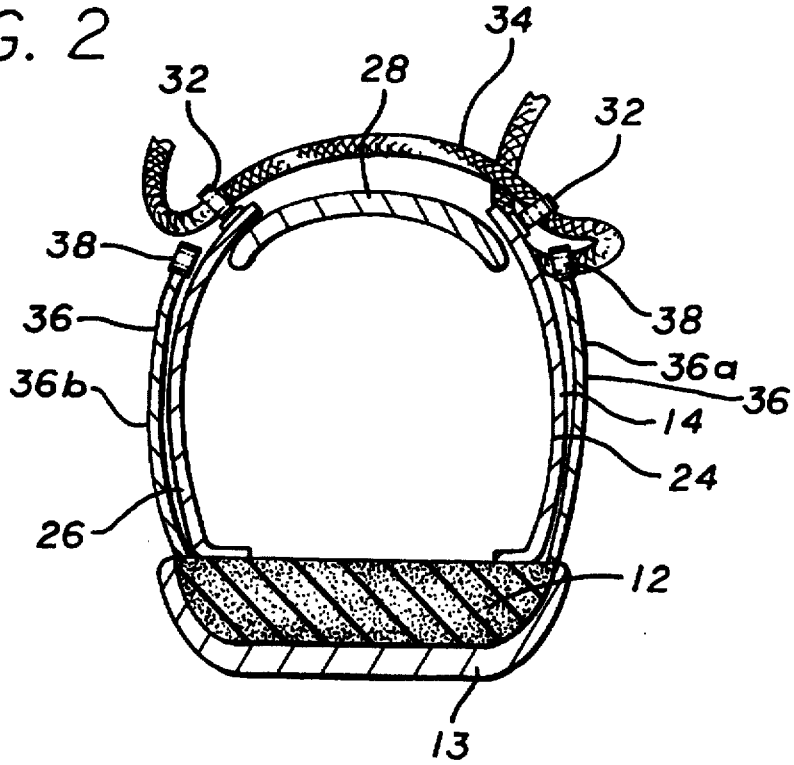
FIG. 2 is a cross-sectional view through view lines 2—2 of FIG. 1.

Referring first to FIGS. 1 and 2, there is depicted an athletic shoe 10, having a mid-sole 12, an outsole 13, a generally inelastic upper 14 with a toe or vamp area 16, a quarter region 18 which lies in the eyelet lacing area 20 of the shoe 10, and a heel cup or counter area 22. The quarter area 18 has medial and lateral sides 24 and 26, respectively. A tongue portion 28 lies adjacent to the inside of the upper 14 and is located in the lacing area 20. Located in the lacing area 20 are a series of lacing eyelet holes 30 and/or lacing rings 32. Conventional laces 34 are used with the shoe 10. So far as described, the lacing system is known in the art.

The shoe lacing system further includes a shock absorbing and tensioning member 36, which is attached near its lower region to the quarter region 18 of the upper 14, to the mid-sole 12 of the shoe 10, or between the mid-sole 12 and the outsole 13. The shock absorbing and tensioning members 36 can be positioned at either or both the medial and lateral sides of the shoe 10, as desired, and overlies and is more elastic than the upper 14 of the shoe 10.

Ideally, a shock absorbing and tensioning member 36 will be located at both the medial and lateral sides of shoe 10. Depending upon any problems of pronation or supination which the wearer desires to correct, the wearer can selectively lace the conventional shoe laces 34 through one of the two shock absorbing and tensioning members 36, thereby tending to put additional elastic force on the side of the shoe 10 through which the shoe lace 34 is looped through the shock absorbing and tensioning member 36. For example, to aid in correcting for pronation, the wearer will engage the shoe lace 34 with the shock absorbing and tensioning member **36*a* positioned on the medial side of the shoe 10. The extra tensioning force created on the medial side of the shoe 10 will result in the foot being more snugly restricted in the medial side of the shoe 10, and will thereby tend to prevent the wearer's foot from pronating downwardly at the medial edge of the shoe. Correspondingly, to compensate for supination, the wearer will engage the shoe lace 34 with the shock absorbing and tensioning member 36*b* positioned on the lateral side of the shoe 10. The extra tensioning force created on the lateral side of the shoe 10 will result in the foot being more tightly restricted in the lateral side of the shoe 10, and thereby tend to prevent the wearer's foot from supinating downwardly at the lateral edge of the shoe. For shoe wearers who do not experience supination and/or pronation, the shoe wearer can lace the shoe lace 34 through both of the shock absorbing and tensioning member 36*a* and 36*b*, to gain maximum shock absorbing capacity and thereby ensure a close fit of the shoe 10** to the wearer's foot.

The existence of the shock absorbing and tensioning members **36*a* and 36*b*** in effect can act much as do elastic bandages which are frequently wrapped around the feet and ankles to offer additional support and stability.

In cases where only one of the two shock absorbing and tensioning members 36a and 36b are being utilized, the unused shock absorbing and tensioning member 36a or 36b can be retained near its upper region to prevent it from flapping relative to the upper 14. The retention can be accomplished by a loop means on the upper 14, detachable attachment means, such as the hook and lace material VELCRO®, or by other known means (not shown).

Shoe lace receiving means 38 are located at the top region of the shock absorbing and tensioning member 36. These shoe lace receiving means 38 can comprise apertures in the shock absorbing tensioning member 36, or rings or loops or other known means. As depicted in FIG. 1 and 2, "D" rings 38 are employed. The shock absorbing and tensioning member 36 can be made of natural or synthetic rubber, plastic, or other known materials which have sufficient elasticity. The lace 34 is threaded through the "D" rings 38 as well as the other eyelets 30 and lacing rings 32. During the lacing of the shoe 10, sufficient tension can be put on the lace 34, such that the lace 34 will transfer pulling tension to shock absorbing tensioning member 36. Due to the elastic nature of the shock absorbing tensioning member on 36, upon compression of the wearer's foot in the shoe 10, sufficient shoe lace 34 tension will be maintained, thereby assuring that the fit of the shoe 10 to the wearer's foot is also maintained.

As depicted in FIG. 1, the shock absorbing tensioning member 36 has two upwardly projecting fingers 40 and 42, to which are affixed the "D" rings 38. Referring to FIG. 2, the shock absorbing and tensioning member 36 preferably rides on the outside of the upper 14 of the shoe 10, and is preferably unattached to the shoe near its upper region carrying the "D" rings 38. If desired, the shock absorbing and tensioning member 36 can be attached to the upper 14 by stitch lines 44. By varying the relative length of the fingers 40 and 42, the shock absorbing capacity provided by each finger 40 and 42 of the shock absorbing and tensioning member 36 can be independently varied, and the lace tension will more precisely match the requirements.

Referring to FIGS. 1 and 2, in cases where one of the shock absorbing and tensioning member 36a or 36b are not utilized, the lacing hooks 32 or lacing eyelets 30 (FIG. 4) in line with the shoe lace receiving means 38 not being utilized can be used to retain the shoe lace 34.

Figure 3:
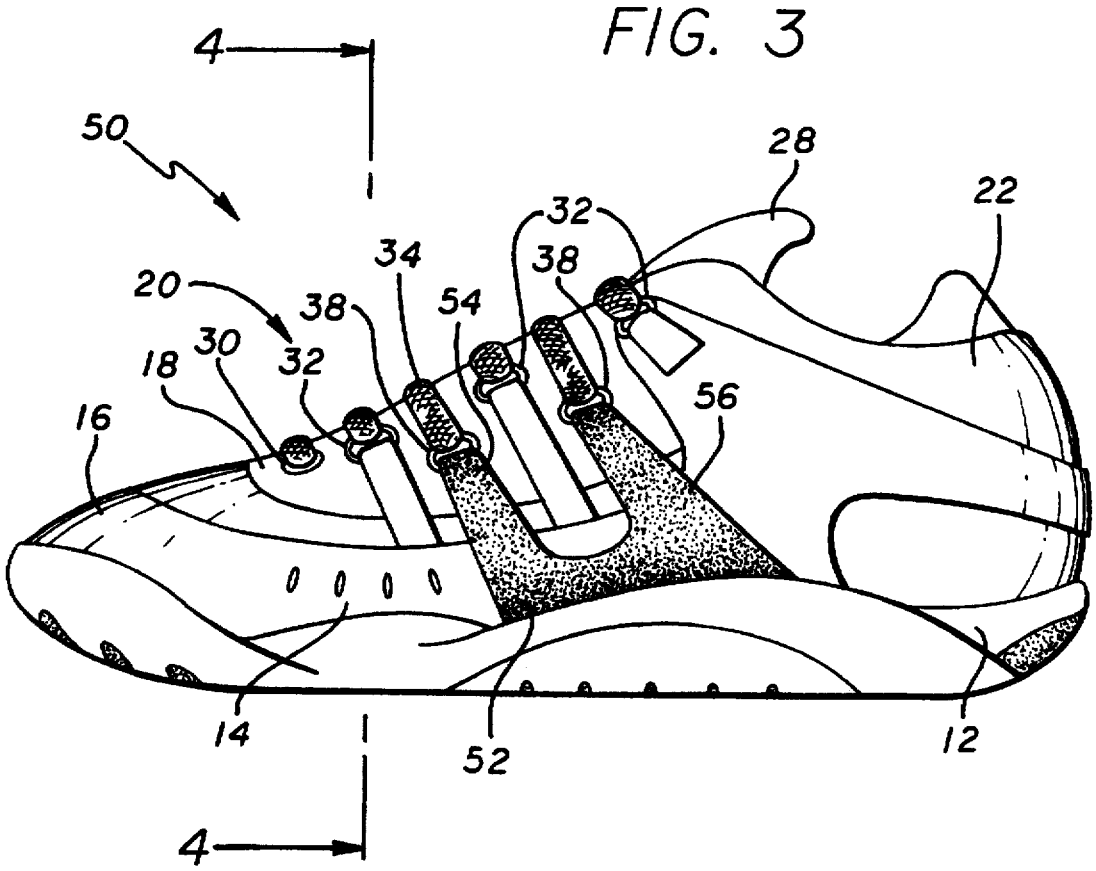
FIG. 3 is a second embodiment of the shock absorbing lace system of the invention.
Figure 4:
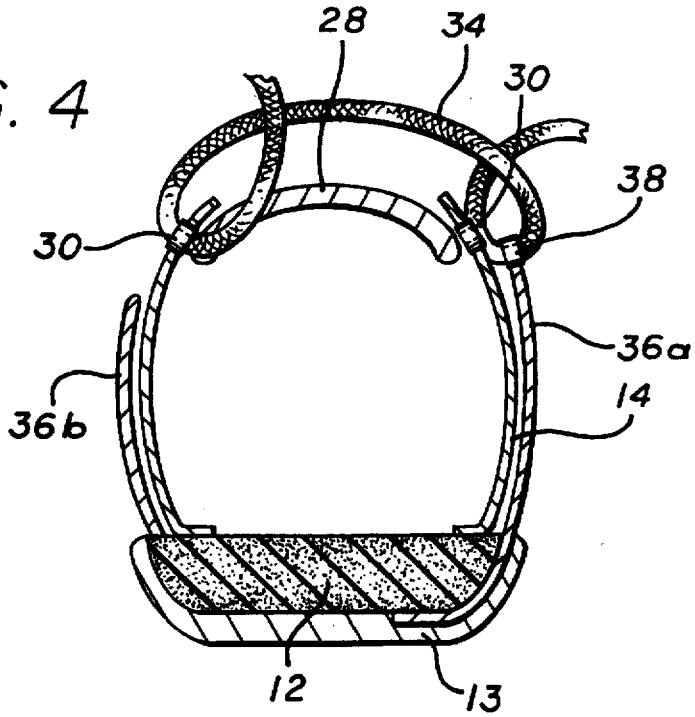
FIG. 4 is a cross-sectional view through view lines 4—4 of FIG. 3.

Alternate embodiments of shoes incorporating shock absorbing and tensioning members are illustrated in FIGS. 3–6, and like reference numerals refer to like elements shared between these shoes and that of FIGS. 1 and 2. Referring first to FIGS. 3 and 4, the shoe 50 is very similar to that of FIGS. 1 and 2, except that the shock absorbing and tensioning member 52 has fingers 54 and 56 which extend from a point nearer the sole 12 of the shoe than the shock absorbing and tensioning member 36 of FIGS. 1 and 2. As noted above, the longer fingers 52 and 56 will allow each finger 52 and 56 to more independently tension the portion of shoe lace 34 threaded therethrough.

Figure 5:
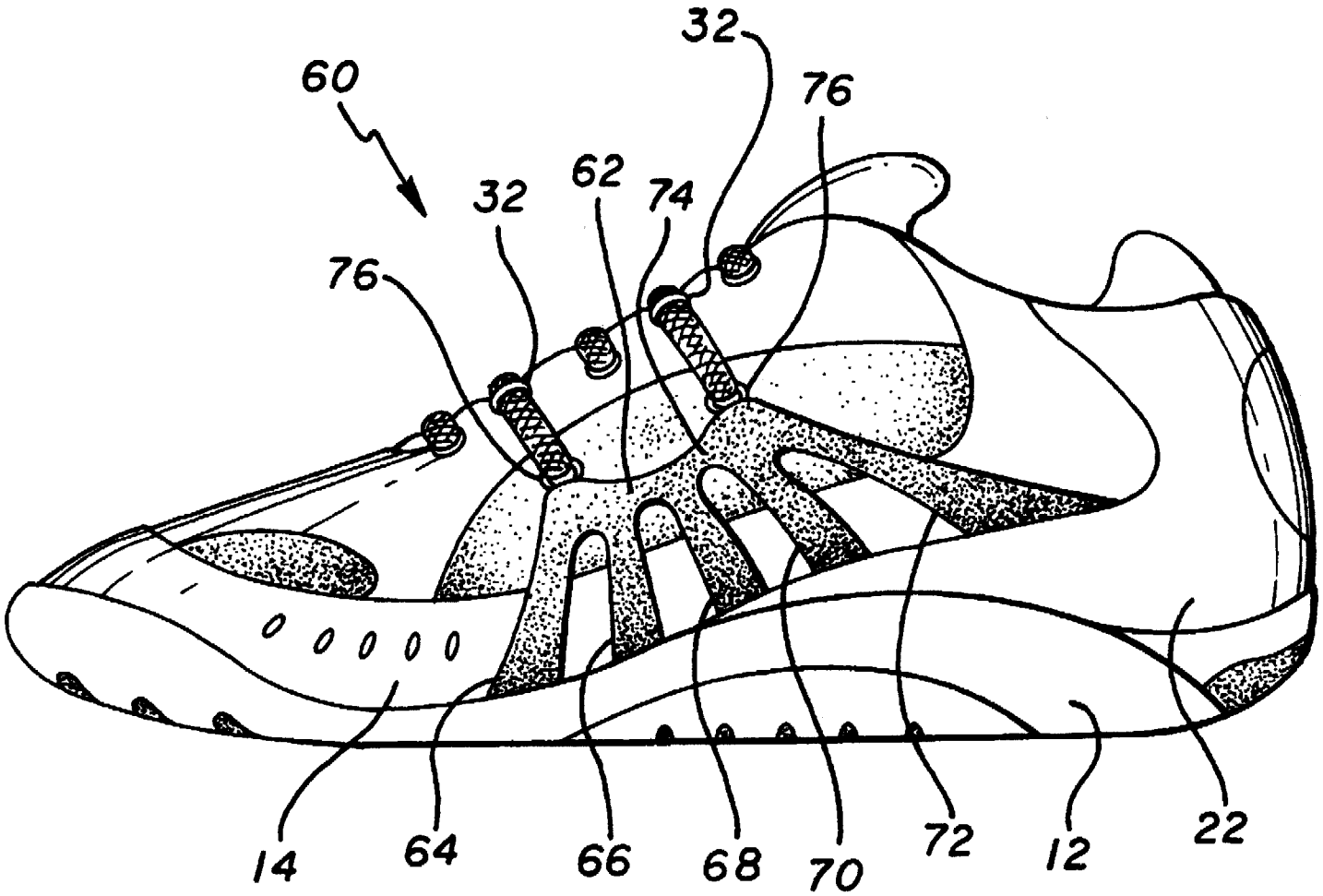
FIG. 5 is a third embodiment of the shock absorbing lace system of the invention.

Referring to FIG. 5, the shoe 50 has a different style of shock absorbing and tensioning member 62, with several fingers 64, 66, 68, 70, and 72. However, the shock absorbing and tensioning member 62 is arranged such that the fingers 64–72 are affixed at or near their lower ends to the upper and/or sole 12 of the shoe 60. The upper ends of the fingers 64–72 are all joined together to a section of material 74 which has lace receiving means 76 affixed thereto. Preferably, the shock absorbing and tensioning member 62 is a unitary member. The shock absorbing and tensioning member 62 of FIG. 4 has advantages over the shock absorbing and tensioning member 36 and 52 of the shoes 10 and 30 in that this arrangement can result in more even distribution of the lacing tension from the lacing area of the shoe 10 to the entire or selected areas of the upper 14 of the shoe 10. For example, finger 72 will tend to put slight tension on the counter region 22 of the shoe 60, thus contributing to a better fit of the counter region 72 of the shoe 60 to the wearer's heel.

Referring to FIGS. 1–4, the fingers of the shock absorbing and tensioning member 36 can be made to lie adjacent so that they carry adjacent lacing hooks or rings, or can be spaced apart and separated by other hooks or rings not carried by fingers. Furthermore, shock absorbing and tensioning members 36 having more than two fingers can be used, as in the shoe of FIG. 5. In addition, the length of the fingers can be varied as well.

The particular materials, shape, and dimensions of the shock absorbing and tensioning member 36 can be chosen to give the shoes 10 the desired shock absorbency and lace tensioning characteristics. However, the shock absorbing and tensioning member 30 will be more flexible and elastic than the material of the upper 14, and will thus adapt the upper to the wearer's foot.

The drawings and the foregoing description are not intended to represent the only form of the invention in regard to the details of its construction an manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

I claim:

1. A shoe having a mid-sole and an outsole, an upper affixed to the mid-sole, the upper having a vamp area, a quarter area with a conventional lacing area with lace attachment means positioned along the longitudinal line of the shoe, and a counter area, and a conventional shoe lace, which shoe includes a shock absorbing shoe lacing system, comprising:

at least one member for absorbing shock and tensioning the shoe, which member has a top and a bottom region, the member having a greater elasticity than the upper, the member being attached at its bottom region to at least one of the outsole, the mid-sole, and the upper of the shoe in the quarter area of the shoe, and to at least one of the medial and lateral sides of the shoe, the member overlying the upper of the shoe and having at least one lace engagement means positioned at its top region for engaging with the shoe lace;

whereby at least one of the members can be manually placed under elastic tension, as desired, by lacing the conventional shoe lace through at least one of the lace engagement means of the member and the lace attachment means in the quarter area of the shoe, thereby providing enhanced shock absorbance and fitting of the shoe to the wearer's foot.

2. The shoe of claim 1, wherein the member has a plurality of spaced apart fingers at its top region, to which the lace engagement means are attached.

3. The shoe of claim 1, wherein at least the top region of the member is free floating on the outside of the upper.

4. The shoe of claim 1, wherein the member is comprised of elastic material.

5. The shoe of claim 1, wherein the member is attached to at least one of the upper, mid-sole and outsole of the shoe by a plurality of spaced apart fingers at its bottom region, and the member has the lace engagement means located at its upper region.

6. The shoe of claim 1, wherein the shoe laces are inelastic.

7. The shoe of of claim 1, wherein the member is comprised of unitary construction.

8. A shoe having a sole, an upper with a vamp area, a quarter area with lace attachment means positioned thereon, and a counter area, and a substantially inelastic conventional shoe lace, which shoe includes a shock absorbing shoe lacing system, comprising:

at least one elastic member for absorbing shock and tensioning the shoe, having a plurality of fingers at an upper region, which overlies the upper of the shoe and which is comparably more elastic than the upper, each finger carrying a shoe lace engaging member, a lower region which is affixed to at least one of the quarter, mid-sole and outsole, at least one of the medial and lateral sides of the shoe, the upper region of the shock absorbing and tensioning member being free floating on the outside of the upper, whereby when the conventional shoe lace is laced in a serpentine manner through the shoe lace engaging members of the and the lace attachment means, thereby placing the member under elastic tension, the fit of the shoe to the wearer's foot can be adjusted.

9. The shoe of claim 8 wherein the member is comprised of unitary construction.

10. In footwear comprising a sole, an upper affixed to the sole comprising a vamp section, a quarter section and a counter section, and means for lacing the upper quarter section, the improvement which comprises:

an elastic strap which may be placed under tension manually overlying the upper and positioned in the quarter area of the shoe, the elastic strap being more elastic than the upper;

a lower edge of the elastic strap being affixed to at least one of the quarter areas of the upper and the mid-foot area of the sole, upper portions of the elastic strap being connectable to lacing having transversely extending components, whereby tension on the elastic strap can be normally adjusted by the lacing, and whereby toe-off tension in the elastic strap is decreased, and foot-strike tension on the elastic strap is decreased, thereby providing shock absorption.

11. The footwear of claim 10, wherein the elastic strap is of unitary construction.

12. In footwear comprising a sole, a non-elastic upper affixed to the sole, the upper comprising a vamp section, a quarter section and a counter section, and a non-elastic shoe lace for lacing the upper quarter section along a longitudinal axial direction, the improvement which comprises:

an elastic strap portion which may manually be placed under tension and which overlies the upper and is positioned in the quarter area of the shoe, the elastic strap portion being more elastic than the upper, a lower edge of the elastic strap portion being affixed to at least one of the quarter areas of the upper and mid-foot area of the sole, upper portions of the elastic strap portion being connectable to generally transversely extending components of the shoe lace, wherein the elastic strap portion comprises a wide lower portion and a narrower upper portion terminating in a plurality of connector strips approximately the same width as the shoe lace, the connector strips having connector means which permit the shoe lace to be engaged with the strips, whereby tension on the elastic strap portion can be normally adjusted by the tension placed on the shoe lace, and whereby toe-off tension in the elastic strap portion is decreased, and foot-strike tension on the elastic strap portion is decreased, thereby providing shock absorption.

13. The footwear of claim 12, wherein the lacing means comprises conventional non-elastic shoe lace and the elastic strap portion comprises a wide lower portion and a narrow upper portion terminating in a plurality of connector strips approximately the same width as the shoe lace, the connector strips having connector means directly connecting the lacing means to the strips.

14. The footwear of claim 12, wherein the elastic strap portion comprises a plurality of connector strips, the connector strips having in its upper portion, connection means which are directly connected to the lacing means.

15. The footwear of claim 9, wherein the elastic strap portion is of unitary construction.

16. In footwear comprising a sole, a non-elastic upper affixed to the sole, the upper comprising a vamp section, a quarter section and a counter section, and a non-elastic shoe lace for lacing the upper quarter section, along a longitudinally axial direction, the improvement which comprises:

an elastic strap portion which may manually be placed under tension and which overlies the upper and is positioned in the quarter area of the shoe, the elastic strap portion comprising a wide lower portion affixed to at least one of the quarter areas of the upper and mid-foot area of the sole, and a narrower upper portion terminating in at least one connector strip having connector means which permit the elastic strap portion to be engaged with the shoe lace, whereby tension on the elastic strap portion can be normally adjusted by the tension placed on the shoe lace, and whereby, upon toe-off, tension in the elastic strap portion is decreased, and upon foot-strike tension on the elastic strap portion is decreased, thereby providing shock absorption.

17. The footwear of claim 16, wherein the connector means are lace receiving D-rings.

18. The footwear of claim 16, wherein the elastic strap portion is of unitary construction.

* * * * *